US010288371B2

(12) United States Patent
Maga

(10) Patent No.: US 10,288,371 B2
(45) Date of Patent: May 14, 2019

(54) SIDE-LOADING FIXED MAGAZINE WITH RETRACTABLE FOLLOWER AND SLIDING AMMUNITION LOADING PANEL

(71) Applicant: David Dallas Maga, Castaic, CA (US)

(72) Inventor: David Dallas Maga, Castaic, CA (US)

( * ) Notice: Subject to any disclaimer, the term of this patent is extended or adjusted under 35 U.S.C. 154(b) by 0 days.

(21) Appl. No.: 15/950,115

(22) Filed: Apr. 10, 2018

(65) Prior Publication Data

US 2018/0292154 A1 Oct. 11, 2018

Related U.S. Application Data

(60) Provisional application No. 62/483,814, filed on Apr. 10, 2017.

(51) Int. Cl.

| | |
|---|---|
| ***F41A 9/65*** | (2006.01) |
| ***F41A 17/38*** | (2006.01) |
| ***F41A 9/67*** | (2006.01) |
| ***F41A 3/66*** | (2006.01) |
| ***F41A 9/70*** | (2006.01) |

(52) U.S. Cl.
CPC ..... *F41A 17/38* (2013.01); *F41A 3/66* (2013.01); *F41A 9/67* (2013.01); *F41A 9/70* (2013.01)

(58) Field of Classification Search
CPC ..... F41A 9/65; F41A 9/67; F41A 9/83; F41A 9/71; F41A 17/38
USPC ..... 42/50, 49.01, 18, 87
See application file for complete search history.

(56) References Cited

U.S. PATENT DOCUMENTS 1,797,951 A * 3/1931 Gaidos ..... F41A 9/67 42/50
2,477,936 A * 8/1949 Molins ..... F41A 9/76 89/33.01
2,585,738 A * 2/1952 Chapin ..... F41A 9/55 42/18

(Continued)

FOREIGN PATENT DOCUMENTS

WO 2009032742 A 3/2009

OTHER PUBLICATIONS

Website Link: https://www.armaglock.com/ Downloaded Jan. 12, 2017 AR-15 Fixed Magazine.

(Continued)

*Primary Examiner* — Michael D David
(74) *Attorney, Agent, or Firm* — Russ Weinzimmer & Associates, P.C.

(57) ABSTRACT

An affixable magazine in compliance with new firearms laws that enables citizens to legally own and effectively operate a firearm, such as an AR-15. The affixable magazine allows a user to easily load ammunition through a sliding panel without removing the magazine from the firearm, disassembling the action, or using tools. The affixable magazine includes: a magazine body configured to contain a stack of cartridges, and an attachable blocking tab for blocking removal of the ammunition magazine from the magazine well, the attachable blocking tab being attached after insertion of the ammunition magazine into the magazine well, and before re-engaging the upper receiver with the lower receiver. The affixable magazine also includes a magazine body having an opening, with a sliding panel configured to alternately cover or reveal the opening, the magazine body including: at least one finger-pull slot with a bottom hook for locking the follower.

18 Claims, 8 Drawing Sheets

(56) References Cited

U.S. PATENT DOCUMENTS

| | | | | |
|---|---|---|---|---|
| 2,908,987 | A * | 10/1959 | Allyn | F41A 9/65 124/52 |
| 3,005,279 | A * | 10/1961 | Brewer | F41A 3/22 42/18 |
| 4,430,821 | A | 2/1984 | Vincent | |
| 4,502,237 | A * | 3/1985 | Krogh | F41A 9/70 42/50 |
| 4,588,240 | A | 5/1986 | Ruehl et al. | |
| 4,614,052 | A | 9/1986 | Brown et al. | |
| 4,688,344 | A | 8/1987 | Kim | |
| 4,707,941 | A * | 11/1987 | Eastman | F41A 9/68 42/49.02 |
| 5,278,690 | A | 1/1994 | Vella-Coleiro | |
| 5,461,811 | A | 10/1995 | Ciener | |
| 5,697,179 | A * | 12/1997 | Vanmoor | F41A 9/65 42/50 |
| 5,806,224 | A | 9/1998 | Hager | |
| 6,212,815 | B1 * | 4/2001 | Fitzpatrick | F41A 9/65 224/196 |
| 6,311,603 | B1 | 11/2001 | Dunlap | |
| 6,481,136 | B1 | 11/2002 | Fitzpartick | |
| 6,739,082 | B2 | 5/2004 | Christensen | |
| 6,807,764 | B1 * | 10/2004 | Phillips | F41A 9/83 42/87 |
| 7,162,824 | B1 | 1/2007 | McCormick | |
| 7,200,964 | B2 * | 4/2007 | Gates | F41A 9/67 42/49.01 |
| 7,444,775 | B1 | 11/2008 | Schuetz | |
| 7,497,044 | B2 | 3/2009 | Cammenga et al. | |
| 7,941,955 | B2 | 5/2011 | Stone | |
| 8,316,567 | B2 * | 11/2012 | Douglas | F41A 9/67 42/50 |
| 8,418,390 | B1 | 4/2013 | Wright | |
| 8,720,095 | B2 * | 5/2014 | Wright | F41A 9/65 42/50 |
| 8,756,845 | B2 | 6/2014 | Harris et al. | |
| 9,103,614 | B2 * | 8/2015 | Froehle | F41A 9/67 |
| 9,121,652 | B1 | 9/2015 | Mangiameli | |
| 9,303,934 | B1 * | 4/2016 | Kazsuk | F41A 9/83 |
| 9,341,421 | B2 | 5/2016 | Findlay | |
| 9,395,130 | B2 | 7/2016 | Jacobson | |
| 9,482,478 | B2 | 11/2016 | Newman | |
| 9,683,797 | B2 * | 6/2017 | Boyarkin | F41A 9/67 |
| 2011/0173858 | A1 * | 7/2011 | Troy | F41A 9/65 42/50 |
| 2014/0223790 | A1 | 8/2014 | Wilson | |
| 2015/0096214 | A1 * | 4/2015 | Jones, III | F41A 9/71 42/49.01 |
| 2015/0276339 | A1 * | 10/2015 | Shreve | F41A 11/00 42/50 |

OTHER PUBLICATIONS

Website Link: http://www.gunauction.com/buy/10420062 Downloaded Jan. 12, 2017 Semi-Auto Rifle Fixed Magazine.

Website Link: https://www.youtube.com/watch?v=F0nnd0Parco Downloaded Jan. 12, 2017 ARMagLock Install By installing an ARMagLock you no longer own a "detachable" magazine firearm. ARMagLock renders your MIL-SPEC AR-15 (and AR-10) a fixed magazine firearm while installed.

* cited by examiner

SIDE-LOADING FIXED MAGAZINE WITH RETRACTABLE FOLLOWER AND SLIDING AMMUNITION LOADING PANEL

CROSS-REFERENCE TO RELATED APPLICATIONS

This application claims priority to Provisional Application No. 62/483,814, filed Apr. 10, 2017, entitled "Fixed Firearms Magazine Loadable Via a Downward-Sliding Wall", the entire contents of which is herein incorporated by reference.

FIELD OF INVENTION

This invention relates generally to magazines for use with firearms, and more particularly to magazines that are fixed to a firearm such that the magazine is not removable from the firearm.

BACKGROUND OF THE INVENTION

Firearm laws have been passed in states such as California and New York which require that certain rifles and pistols must be modified to remain legal. In particular, semi-automatic firearms, such as AR-15 rifles and pistols, are being subject to more restrictions, including a prohibition against "detachable magazines". California law, for example, requires a "fixed magazine", where "fixed magazine" means an ammunition feeding device contained in, or permanently attached to, a firearm in such a manner that the device cannot be removed without disassembly of the firearm action.

Standard semi-automatic firearms have typically been made and sold for use with detachable magazines. In response to the restrictions of the newer firearms laws, semiautomatic firearms are being made and sold with fixed magazines. Further, conversion kits are being sold to convert a firearm with a detachable magazine to a firearm with a fixed magazine.

For example, Hager U.S. Pat. No. 5,806,224 teaches a semi-automatic firearm with a non-removable magazine. Also, Stone U.S. Pat. No. 7,941,955 B2 teaches a pivoting, non-detachable magazine. Further, Harris et al. U.S. Pat. No. 8,756,845 B2 teaches method and device for converting a firearm with detachable magazine to a firearm with a fixed magazine.

SUMMARY OF THE INVENTION

By providing a fixed magazine according to the new firearms laws of many states, citizens of those states will be able to legally own a firearm, such as an AR-15.

The fixed magazine of the invention satisfies the new firearms laws, being loadable in a way that does not violate the law.

The fixed magazine of the invention is a plastic or metal magazine for centerfire rifles which can be fixed into position so as to become a non-removable magazine, yet it can open while attached to the rifle for easy loading of cartridges.

The method of attachment of the fixed magazine will vary in accordance with the different makes and models of each rifle. The end result of the fixing of the magazine will be compliance with state or local laws, while also facilitating loading of the magazine in a convenient manner.

The fixed magazine of the invention allows a user to easily load the fixed magazine with ammunition without removing the magazine from the firearm, disassembling the action, or using tools. (If this is not legal in your state, a fixed magazine will be provided that requires a tool to open it to load ammunition, but it will open in the same manner as a fixed magazine that does not require a tool.)

A general aspect of the invention is an affixable ammunition magazine for use with a firearm having an upper receiver and a lower receiver, the lower receiver having a magazine well for receiving the ammunition magazine. The ammunition magazine includes: a magazine body configured to contain a stack of cartridges, the magazine body having a feeding end configured to feed rounds of ammunition to the firearm, the magazine body including: a sliding side panel configured to slide downward from a closed position to an open position so as to permit loading of the stack of cartridges into the magazine body, and a rear side having a finger-pull slot terminating as a bottom hook; a cartridge follower assembly including: a cartridge follower, at least one finger pull attached to the cartridge follower, the at least one finger pull extending through the finger-pull slot of the rear side, the at least one finger pull being movable when released from the bottom hook, and a cartridge follower spring configured to be compressed by the cartridge follower when the at least one finger pull is engaged with the bottom hook, and configured to expand when the at least one finger pull is disengaged from the bottom hook, thereby allowing the cartridge follower to urge the stack of cartridges towards the feeding end of the ammunition magazine; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

In some embodiments, the cartridge follower includes a rotatable shaft configured to move along and within the finger-pull slot, the at least one finger pull being attached to the rotatable shaft.

In some embodiments, wherein the cartridge follower assembly further includes: a cartridge follower top plate configured to push upward on the bottom of the stack of cartridges; a cartridge follower bottom plate configured to facilitate attachment of the cartridge follower spring to the cartridge follower assembly; a pivot extending from the bottom plate towards the top plate of the cartridge follower; and a pivot block mounted on the pivot so as to enable the pivot block, the rotatable shaft, and the at least one finger pull to pivot.

In some embodiments, wherein the cartridge follower bottom plate includes at least one spring attachment tab configured to attach the cartridge follower spring to the cartridge follower bottom plate.

In some embodiments, the affixable ammunition magazine further includes: a spring loaded button located at a lower portion of the magazine body, the spring loaded button being cooperative with both a lower hole and an upper hole in the sliding side panel, so as to lock the sliding side panel in either the open position, or the closed position.

In some embodiments, the magazine body, the sliding side panel, the cartridge follower, the cartridge follower spring, and the at least one finger pull are each made from at least one of: metal, nylon, plastic, carbon fiber.

Another general aspect of the invention is an affixable ammunition magazine for use with a firearm having an upper receiver and a lower receiver, the lower receiver having a magazine well for receiving the ammunition magazine. This ammunition magazine includes: a magazine body configured to contain a stack of cartridges, the magazine body having a feeding end configured to feed rounds of ammunition to the firearm, the magazine body including: a sliding rear panel configured to slide downward from a closed position to an open position so as to permit loading of the stack of cartridges into the magazine body, and a right side and a left side each having a finger-pull slot terminating as a bottom hook; a cartridge follower assembly including: a cartridge follower, two finger pulls attached to the cartridge follower, the two finger pulls extending through the finger-pull slots of the right and left sides, the two finger pulls being movable when released from the respective bottom hooks, and a cartridge follower spring configured to be compressed by the cartridge follower when the at least one finger pull is engaged with the bottom hook, and configured to expand when the at least one finger pull is disengaged from the bottom hook, thereby allowing the cartridge follower to urge the stack of cartridges towards the feeding end of the ammunition magazine; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

In some embodiments, the two finger pulls are each attached to a respective rotatable shaft configured to ride within respective finger-pull slots.

In some embodiments, the cartridge follower assembly further includes: a cartridge follower top plate configured to push upward on the bottom of the stack of cartridges; a cartridge follower bottom plate configured to facilitate attachment of the cartridge follower spring to the cartridge follower assembly; a pivot extending from the bottom plate towards the top plate of the cartridge follower; and a pivot block mounted on the pivot so as to enable the pivot block, the rotatable shafts, and the two finger pulls to pivot.

In some embodiments, the cartridge follower bottom plate includes at least one spring attachment tab configured to attach the cartridge follower spring to the cartridge follower bottom plate.

In some embodiments, the affixable ammunition magazine further includes: a spring loaded button located at a lower portion of the magazine body, the spring loaded button being cooperative with both a lower hole and an upper hole in the sliding rear panel, so as to lock the sliding rear panel in either the open position, or the closed position.

In some embodiments, the magazine body, the sliding rear panel, the cartridge follower, the cartridge follower spring, and the two finger pulls are each made from at least one of: metal, nylon, plastic, carbon fiber.

Yet another general aspect of the invention is an affixable ammunition magazine for use with a firearm having an upper receiver and a lower receiver, the lower receiver having a magazine well for receiving the ammunition magazine. This ammunition magazine includes: a magazine body configured to contain a stack of cartridges, the magazine body having a feeding end configured to feed rounds of ammunition to the firearm, the magazine body including: a sliding front panel configured to slide downward from a closed position to an open position so as to permit loading of the stack of cartridges into the magazine body, and a right side and a left side each having a finger-pull slot terminating as a bottom hook; a cartridge follower assembly including: a cartridge follower, two finger pulls attached to the cartridge follower, the two finger pulls extending through the finger-pull slots of the right and left sides, the two finger pulls being movable when released from the respective bottom hooks, and a cartridge follower spring configured to be compressed by the cartridge follower when the at least one finger pull is engaged with the bottom hook, and configured to expand when the at least one finger pull is disengaged from the bottom hook, thereby allowing the cartridge follower to urge the stack of cartridges towards the feeding end of the ammunition magazine; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

In some embodiments, the two finger pulls are each attached to a respective rotatable shaft configured to ride within respective finger-pull slots.

In some embodiments, the cartridge follower assembly further includes: a cartridge follower top plate configured to push upward on the bottom of the stack of cartridges; a cartridge follower bottom plate configured to facilitate attachment of the cartridge follower spring to the cartridge follower assembly; a pivot extending from the bottom plate towards the top plate of the cartridge follower; and a pivot block mounted on the pivot so as to enable the pivot block, the rotatable shafts, and the two finger pulls to pivot.

In some embodiments, the cartridge follower bottom plate includes at least one spring attachment tab configured to attach the cartridge follower spring to the cartridge follower bottom plate.

In some embodiments, the affixable ammunition magazine further includes: a spring loaded button located at a lower portion of the magazine body, the spring loaded button being cooperative with both a lower hole and an upper hole in the sliding front panel, so as to lock the sliding front panel in either the open position, or the closed position.

In some embodiments, the magazine body, the sliding front panel, the cartridge follower, the cartridge follower spring, and the two finger pulls are each made from at least one of: metal, nylon, plastic, carbon fiber.

BRIEF DESCRIPTION OF THE DRAWINGS

The invention will be more fully understood from the following detailed description, in conjunction with the following figures, wherein.

DETAILED DESCRIPTION

Figure 1A:
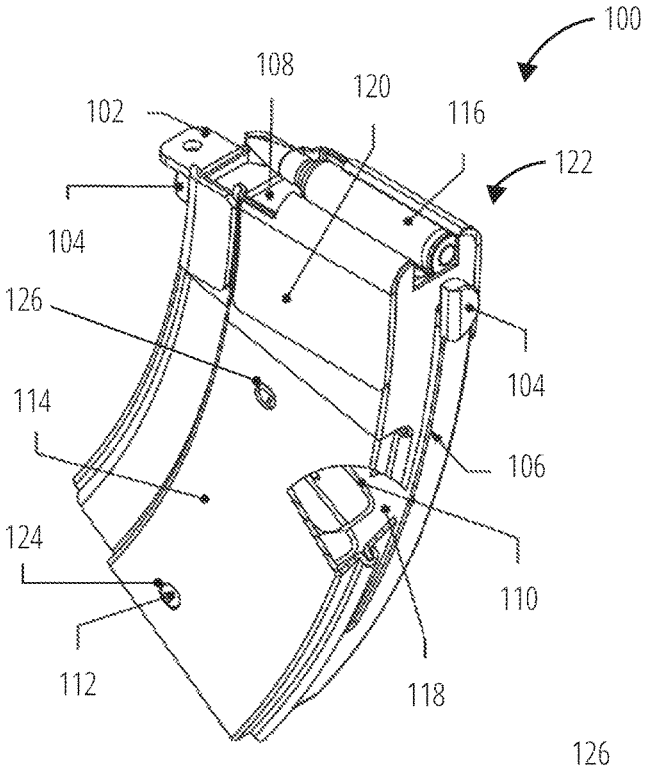
FIG. 1A is a perspective view showing the rear, side, and top views of an embodiment of an ammunition magazine that can be fixed to a firearm, while also facilitating loading of the ammunition magazine via a sliding side panel, with at least one finger pull in the upward position, also showing one cartridge within the ammunition magazine.

With reference to FIG. 1A, a perspective view is shown of an ammunition magazine 100 containing a stack of cartridges 116. The ammunition magazine 100 includes an attachable blocking tab 102 which is to be fixedly attached to a firearm lower receiver (not shown) such that the ammunition magazine 100 is prevented from being easily removed from the firearm, i.e., from the bottom of the magazine well. The attachable blocking tab 102 blocks removal of the ammunition magazine 100 from the magazine well (not shown), the attachable blocking tab 102 being attached at a feeding end 122 after insertion of the ammunition magazine 100 into the magazine well (not shown), and before re-engaging the upper receiver (not shown) with the lower receiver (not shown).

Other embodiments of the ammunition magazine 100 may have alternative fixing methods to the attachable blocking tab 102, such as screws or other types of tabs, and all alternative fixing methods will attach the ammunition magazine 100 to the firearm lower receiver (not shown) in accordance with local laws.

In this embodiment, two finger pulls 104 are configured to be pulled down a finger-pull slot 106 along both sides of the ammunition magazine 100 taking with it a cartridge follower 108 and compressing a spring 110, thereby opening a space within magazine body 118 which is configured to receive the stack of cartridges 116. An ammunition magazine fixed sidewall 120, and a sliding side panel 114 shown in the closed position, cover the magazine body 118. The sliding side panel 114 includes holes 124 and 126 that are cooperative with a spring loaded button 112 configured to pop up and engage with the holes 124 and 126 so as to lock the sliding side panel 114 in either the open position by engaging with the hole 126, or in the closed position by engaging with the hole 124.

Figure 1B:
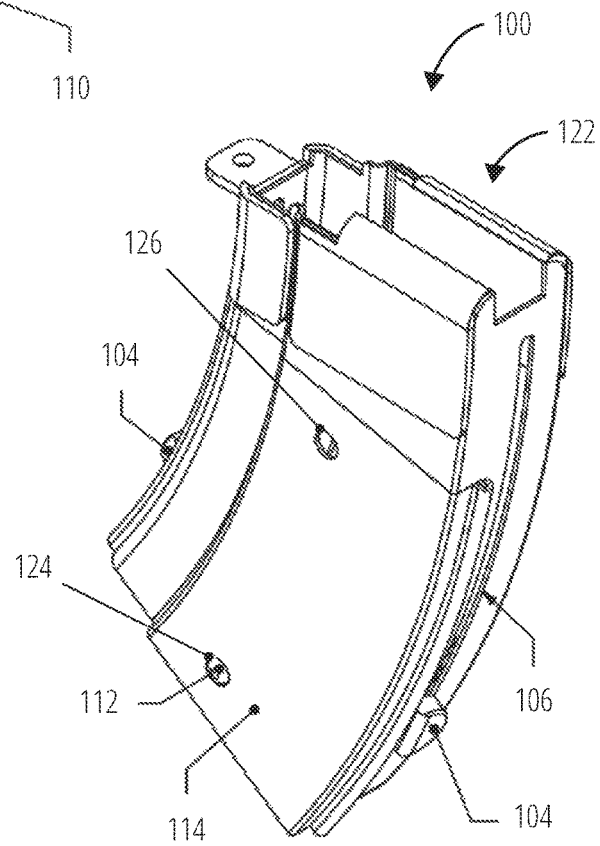
FIG. 1B is a perspective view of the ammunition magazine of FIG. 1A, with the at least one finger pull in the downward position, and the sliding side panel in a closed position.

With reference to FIG. 1B, a perspective view is shown of the ammunition magazine 100 of FIG. 1A with the two one finger pulls 104 in a down position. The finger pulls 104 are configured to be locked in place in the down position by a bottom hook (not shown) in the finger-pull slot 106. The sliding side panel 114 is shown in a closed position, covering the magazine body 118 (shown in FIG. 1A).

Figure 2A:
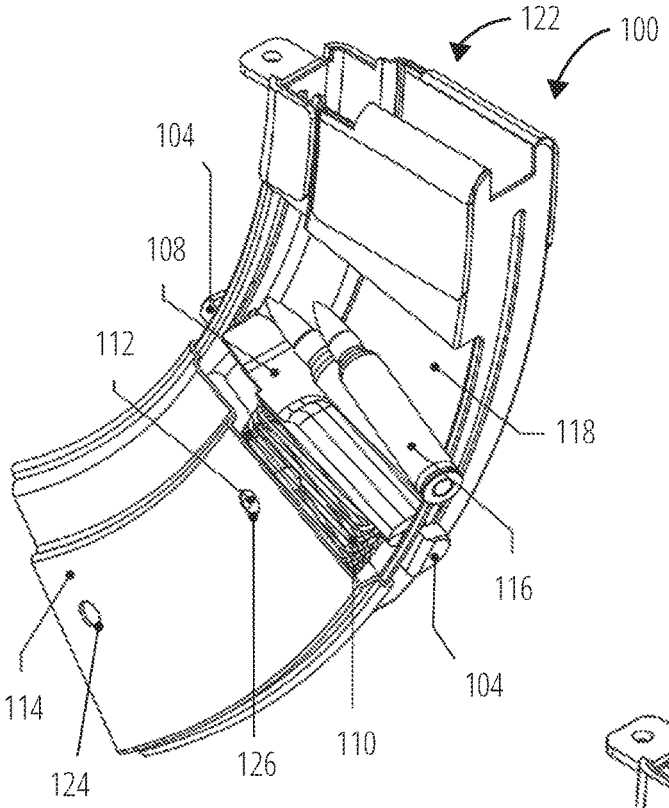
FIG. 2A is a perspective view of the magazine of FIG. 1A, showing the at least one finger pull in the down position, the sliding side panel in the open position, and also showing two cartridges within the ammunition magazine.

With reference to FIG. 2A, a perspective view is shown of the ammunition magazine 100 of FIG. 1A with the two finger pulls 104 rotated, and locked in place in a down position by a bottom hook (not visible in this view) of the finger-pull slot 106, and a spring 110 in a compressed position. A spring loaded button 112 is pushed in to allow a sliding side panel 114 to be slid downward into an open position, revealing a magazine body 118 and two cartridges 116 stacked above a cartridge follower 108.

Figure 2B:
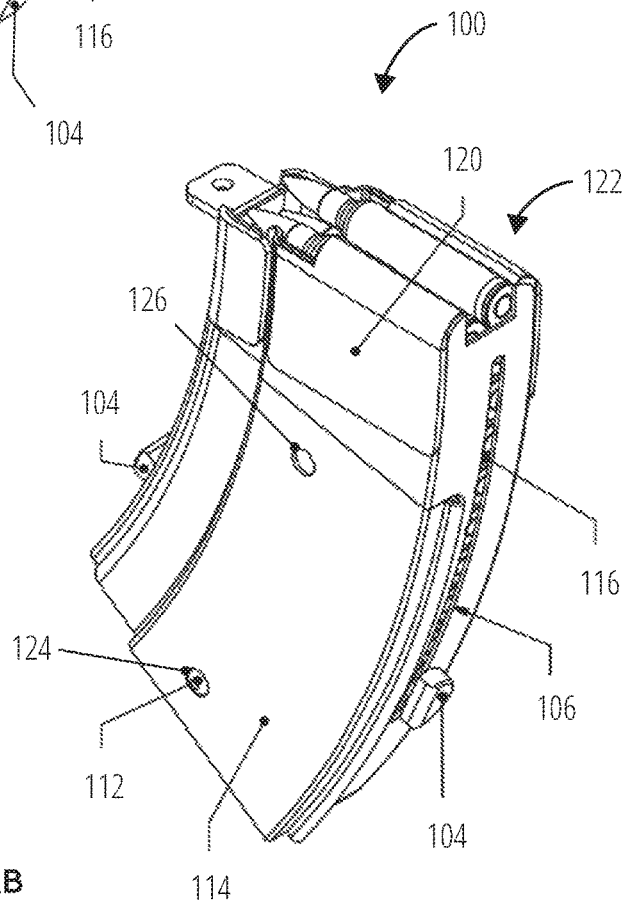
FIG. 2B is a perspective view of the magazine of FIG. 1A, showing the at least one finger pull in the down position, the sliding side panel in the closed position, and also showing a stack of cartridges within the ammunition magazine.

With reference to FIG. 2B, a perspective view is shown of the ammunition magazine 100 of FIG. 1A with the finger pulls 104 in a down position. The finger pulls 104 are locked in place in the down position by a bottom hook (not shown) in the finger-pull slot 106. Below the ammunition magazine fixed sidewall 120, the sliding side panel 114 is shown in a closed position, covering a magazine body 118 (shown in FIG. 1A) which is holding a stack of cartridges 116.

Figure 3A:
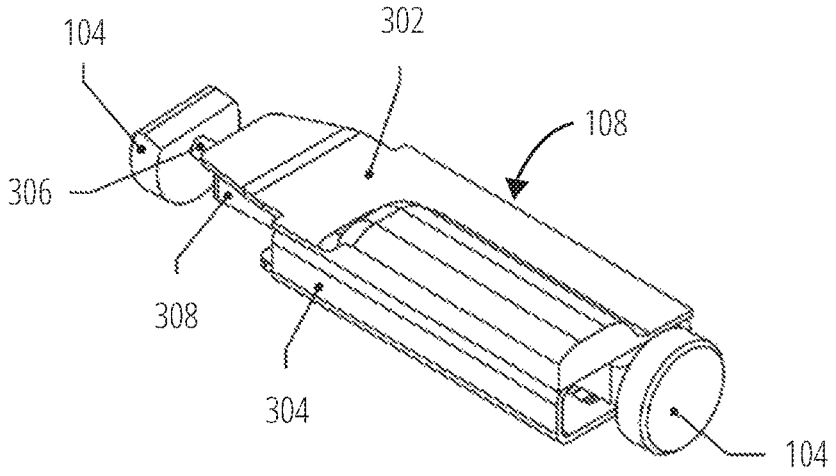
FIG. 3A is a perspective top view showing a cartridge follower having a U-shaped cartridge follower bottom plate and two finger pulls.

With reference to FIG. 3A, a perspective top view is shown of a cartridge follower 108 with a U-shaped cartridge follower bottom plate 304 and two finger pulls 104. A cartridge follower top plate 302 is attached to the U-shaped cartridge follower bottom plate 304.

A rotatable shaft 306 is attached to a cartridge follower pivot block 308. The cartridge follower pivot block 308 extends through the cartridge follower 108 between the cartridge follower top plate 302 and the U-shaped cartridge follower bottom plate 304. Once through the cartridge follower 108, the cartridge follower pivot block 308 terminates at the other rotatable shaft 306. The two finger pulls 104 are attached to the rotatable shaft 306.

Figure 3B:
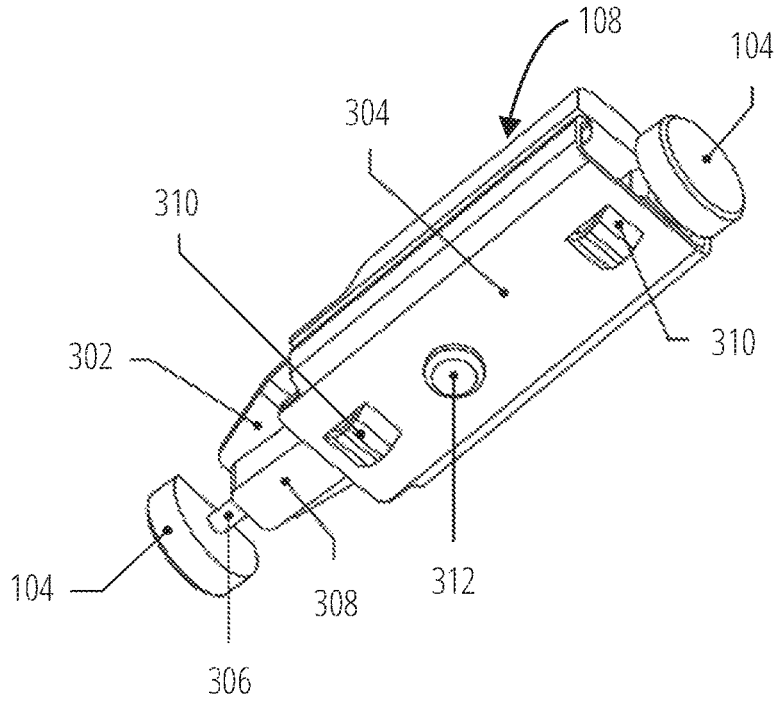
FIG. 3B is a perspective bottom view showing the cartridge follower of FIG. 3A having a U-shaped cartridge follower bottom plate and two finger pulls.

With reference to FIG. 3B, a perspective bottom view is shown of a cartridge follower 108 with a U-shaped cartridge follower bottom plate 304 and the two finger pulls 104.

A rotatable shaft 306 goes into a cartridge follower pivot block 308. A pivot 312 goes through the U-shaped cartridge follower bottom plate 304, through the cartridge follower pivot block 308 and attaches to a cartridge follower top plate 302. The pivot 312 is configured to allow the cartridge follower pivot block 308, the rotatable shaft 306, and the two finger pulls 104 to rotate about the pivot 312. The ammunition magazine spring 110 (shown in FIG. 1A) is attached to the cartridge follower 108 by at least one spring attachment tab 310 attached to the bottom of the U-shaped cartridge follower bottom plate 304.

Figure 4A:
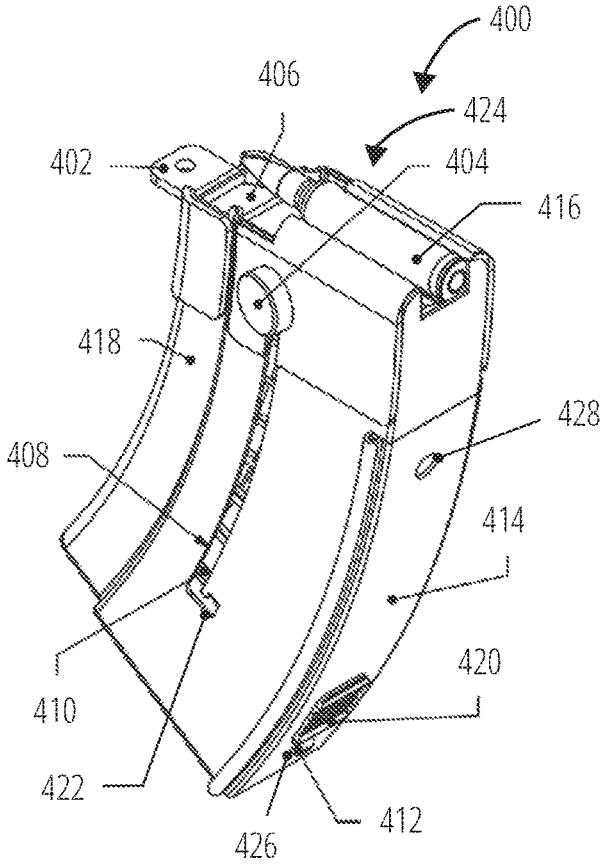
FIG. 4A is a perspective view showing the rear, side, and top views of an embodiment of an ammunition magazine that can be fixed to a firearm, while also facilitating loading of the ammunition magazine via a sliding rear panel, with the finger pull in the upward position, also showing a cartridge within the ammunition magazine.

With reference to FIG. 4A, a perspective view is shown of an ammunition magazine 400 containing a cartridge 416. The ammunition magazine 400 includes an attachable blocking tab 402 which can be fixedly attached to a firearm lower receiver (not shown) such that the ammunition magazine 400 is not easily removed from the firearm. The attachable blocking tab 402 prevents quick removal of the ammunition magazine 400 from the magazine well (not shown), the attachable blocking tab 402 being attached at a feeding end 424 after insertion of the ammunition magazine 400 into the magazine well (not shown), and before re-engaging the upper receiver (not shown) with the lower receiver (not shown).

Other embodiments of the ammunition magazine 400 may have alternative fixing methods to the attachable blocking tab 402, such as screws or other types of tabs, and all alternative fixing methods will attach the ammunition magazine 400 to the firearm lower receiver (not shown) in accordance with local laws.

In this embodiment, the finger pulls 404 are configured to be pulled down a finger-pull slot 408 toward a bottom hook 422 along an ammunition magazine fixed sidewall 418 of the ammunition magazine 400, taking with it a cartridge follower 406 and compressing a cartridge follower spring 410 so as to receive a stack of cartridges 416.

A sliding rear panel 414 is shown in the closed position. The sliding rear panel 414 includes holes 426 and 428 that are cooperative with a spring loaded button 412 configured to pop up and engage with the holes 426 and 428 so as to lock the sliding side panel 414 in either the open position by engaging with the hole 428, or in the closed position by engaging with the hole 426. A raised bump grip 420 is configured to assist a finger of a user (not shown) in opening and closing the sliding rear panel 414.

Figure 4B:
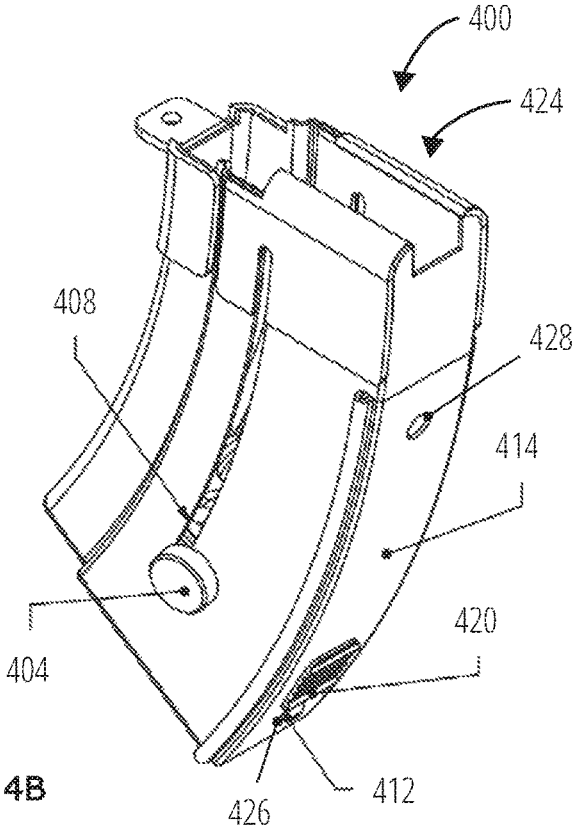
FIG. 4B is a perspective view of the ammunition magazine of FIG. 4A, with the finger pull in the downward position and the sliding rear panel in a closed position.

With reference to FIG. 4B, a perspective view is shown of the ammunition magazine 400 of FIG. 4A with the finger pull 404 pulled down a finger-pull slot 408 to a down position. The finger pull 404 is rotated and locked in place in the down position by a bottom hook 422 (shown in FIG. 4A) in the finger-pull slot 408.

The sliding rear panel 414 is shown in a closed position. To move the sliding rear panel 414 into the closed position, after a spring loaded button 412 is released, the sliding rear panel 414 is pushed upward by a finger of a user (not shown), aided by a raised bump grip 420.

Figure 5A:
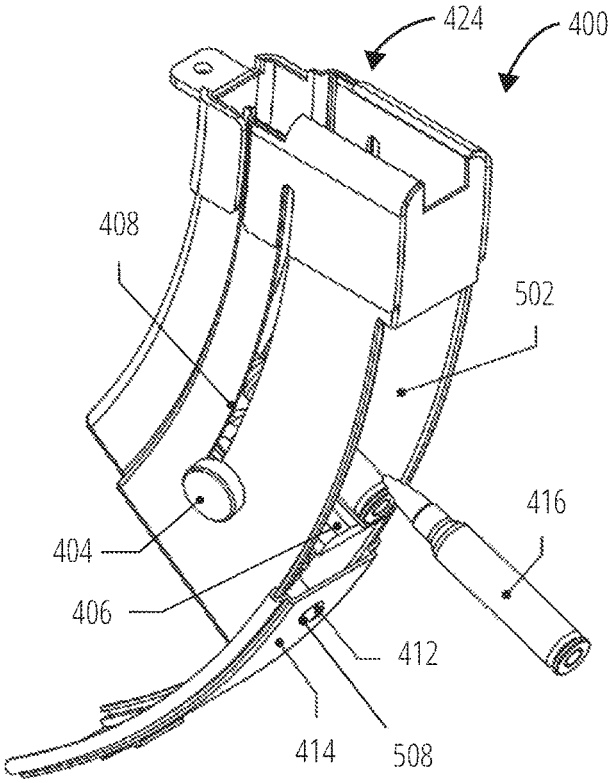
FIG. 5A is a perspective view of the magazine of FIG. 4A, showing a finger pull in the down position, the sliding rear panel in the open position, and also showing cartridges being loaded into the ammunition magazine.

With reference to FIG. 5A, a perspective view is shown of the ammunition magazine 400 of FIG. 4A with at least one finger pull 404 rotated and locked in place in a down position by a bottom hook (not shown) of a finger-pull slot 408, and a cartridge follower spring 410 (shown in FIG. 4A) in a compressed position. A spring loaded button 412 is pushed in to disengage the button 412 from the hole 506 so as to allow a sliding rear panel 414 to be pushed downward into an open position, revealing a magazine body 502 and a space therein to load a stack of cartridges 416 above a cartridge follower 406. In the open position, the hole 508 engages with the button 412, thereby maintaining the sliding rear panel 414 in the open position.

Once the stack of cartridges 416 is loaded, the sliding rear panel 414 can be released by pressing the spring loaded button 412 so as to disengage from the hole 508, and then sliding the sliding rear panel 414 back up into a closed position. At least one finger pull 404 can then decompress the cartridge follower spring 410 (shown in FIG. 4A) and move the cartridge follower 406 up the finger-pull slot 408 to come in contact with and push up the stack of cartridges 416 inside the magazine body 502.

Figure 5B:
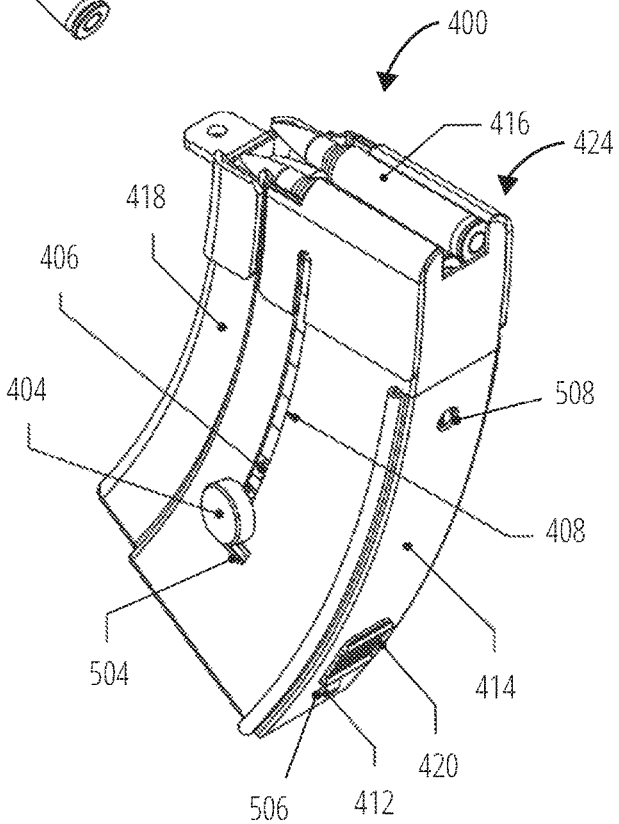
FIG. 5B is a perspective view of the magazine of FIG. 4A, showing a finger pull in the down position near a bottom hook in the groove, the sliding rear panel in the closed position, and also showing a stack of cartridges within the ammunition magazine.

With reference to FIG. 5B, a perspective view is shown of the ammunition magazine 400 of FIG. 5A, showing the finger pull 404 in a down position. The finger pull 404 is shown near a bottom hook 504 of the finger-pull slot 408. The finger pull 404 is locked in place in the down position by engaging with the bottom hook 504 in the finger-pull slot 408 in an ammunition magazine fixed sidewall 418. A sliding rear panel 414 is shown in a closed position, the button 412 engaged with the hole 506, the sliding rear panel 414 covering the space within the magazine body 502 (shown in FIG. 5A) which is shown containing a stack of cartridges 416.

To move the sliding rear panel 414 into the closed position, after a spring loaded button 412 is released, the sliding rear panel 414 is pushed upward by a finger of a user (not shown), aided by a raised bump grip 420.

Figure 6A:
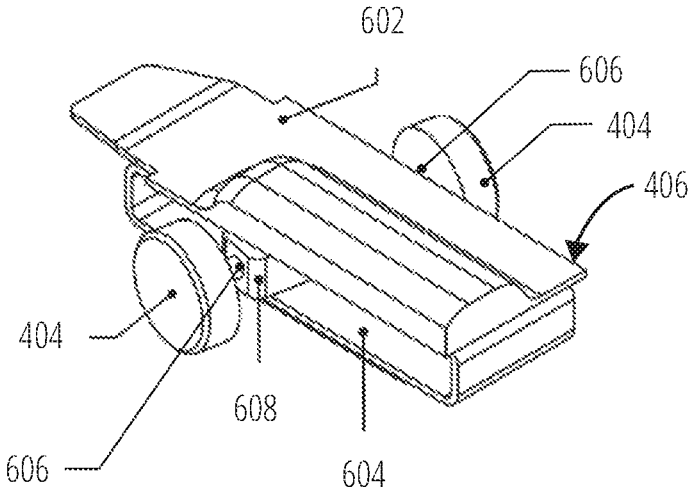
FIG. 6A is a perspective top view showing a cartridge follower with a U-shaped cartridge follower bottom plate and two finger pulls for the embodiment featuring a sliding rear panel.

With reference to FIG. 6A, a perspective top view is shown of a cartridge follower 406 with a U-shaped cartridge follower bottom plate 604 and two finger pulls 404. A cartridge follower top plate 602 is attached to the U-shaped cartridge follower bottom plate 604.

A rotatable shaft 606 is attached to a cartridge follower pivot block 608. The cartridge follower pivot block 608 extends through the cartridge follower 406 between the cartridge follower top plate 602 and the U-shaped cartridge follower bottom plate 604. On the other side of the cartridge follower 406, the cartridge follower pivot block 608 terminates at the rotatable shaft 606. The two finger pulls 404 are attached to the rotatable shaft 606.

Figure 6B:
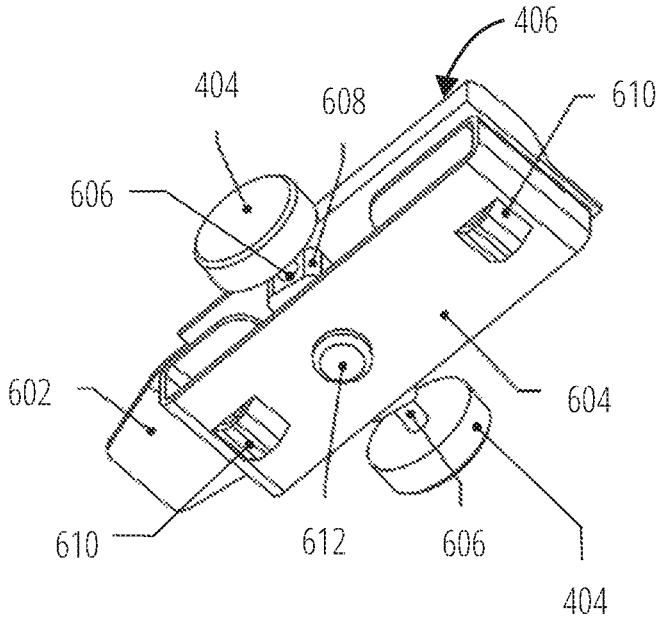
FIG. 6B is a perspective bottom view showing a cartridge follower having a U-shaped cartridge follower bottom plate and two finger pulls for the embodiment featuring a sliding rear panel.

With reference to FIG. 6B, a perspective bottom view is shown of a cartridge follower 406 with a U-shaped cartridge follower bottom plate 604 and the two finger pulls 404.

A rotatable shaft 606 goes into a cartridge follower pivot block 608. A pivot 612 goes through the U-shaped cartridge follower bottom plate 604, through the cartridge follower pivot block 608 and attaches to a cartridge follower top plate 602. The pivot 612 is configured to allow the cartridge follower pivot block 608, the rotatable shaft 606, and each finger pull 404 to rotate about the pivot 612. The cartridge follower spring 410 (shown in FIG. 4A) is attached to the cartridge follower 406 by an at least one spring attachment tab 610 attached to the bottom of the U-shaped cartridge follower bottom plate 604.

Figure 7A:
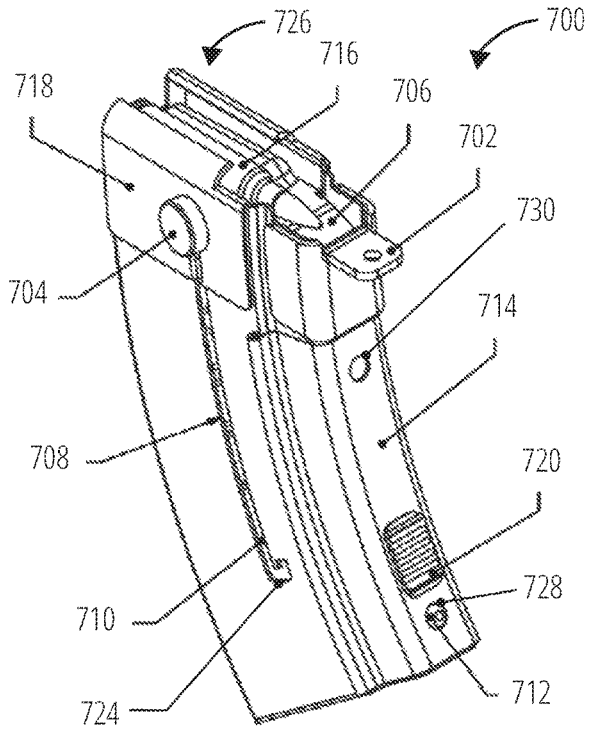
FIG. 7A is a perspective view showing the rear, side, and top views of an embodiment of an ammunition magazine that can be fixed to a firearm, while also facilitating loading of the ammunition magazine via a sliding front panel, with the finger pull in the upward position, also showing a cartridge within the ammunition magazine.

With reference to FIG. 7A, a perspective view is shown of an ammunition magazine 700 for containing a stack of cartridges 716. The ammunition magazine 700 includes an attachable blocking tab 702 which can be fixedly attached to a firearm lower receiver (not shown) such that the ammunition magazine 700 cannot easily removed from the firearm. The attachable blocking tab 702, when attached to the lower receiver, blocks removal of the ammunition magazine 700 from the magazine well (not shown), the attachable blocking tab 702 being attached at a feeding end 726 after insertion of the ammunition magazine 700 into the magazine well (not shown), and before re-engaging the upper receiver (not shown) with the lower receiver (not shown).

Other embodiments of the ammunition magazine 700 may have alternative fixing methods to the attachable blocking tab 702, such as screws or other types of tabs, and all alternative fixing methods will attach the ammunition magazine 700 to the firearm lower receiver (not shown) in accordance with local laws.

In this embodiment, at least one finger pull 704 is configured to be pulled down a finger-pull slot 708 toward a bottom hook 724 along an ammunition magazine fixed sidewall 718 of the ammunition magazine 700, taking with it a cartridge follower 706 and compressing a cartridge follower spring 710 so as to receive a stack of cartridges 716. A sliding front panel 714 is shown in the closed position, covering the raised bump grip 720. The sliding front panel 714 includes a spring loaded button 712 configured to pop up 728 into the hole to lock the sliding front panel 714 in the closed position. A raised bump grip 720 is configured to assist a finger of a user (not shown) in opening and closing the sliding front panel 714.

Figure 7B:
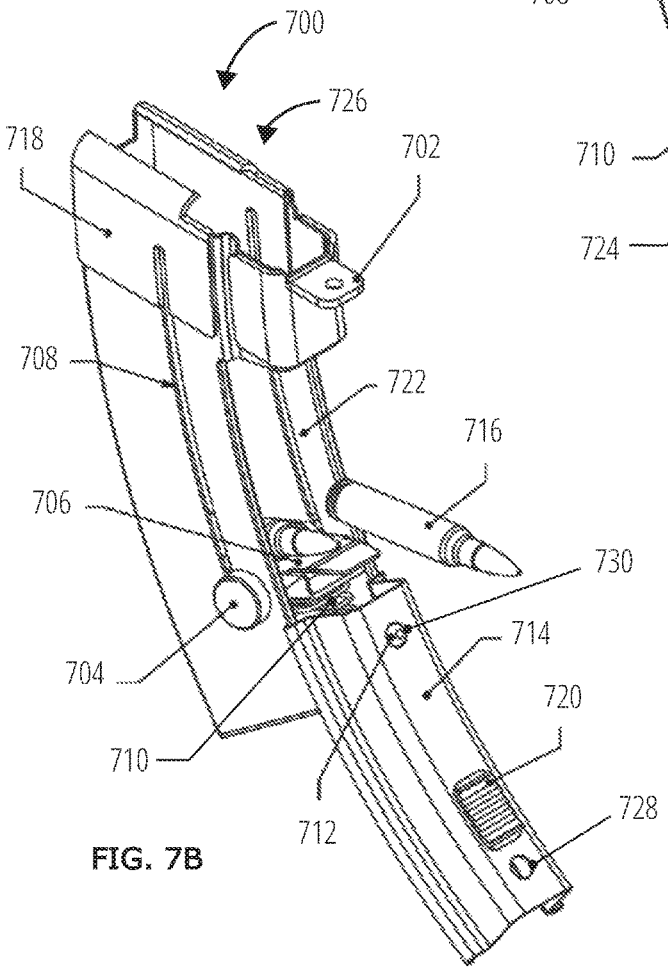
FIG. 7B is a perspective view of the magazine of FIG. 7A, showing a finger pull in the down position, the sliding front panel in the open position, also showing two cartridges being loaded into the ammunition magazine.

With reference to FIG. 7B, a perspective view is shown of the ammunition magazine 700 of FIG. 7A with at least one finger pull 704 rotated and locked in place in a down position by an slot bottom hook 724 (shown in FIG. 7A) of a finger-pull slot 708, and a cartridge follower spring 710 in a compressed position. A spring loaded button 712 is pushed in to disengage the button 712 from the hole 728 so as to allow a sliding front panel 714 to be pushed downward into an open position, revealing a magazine body 722 and a stack of cartridges 716 being stacked above a cartridge follower 706.

Once the stack of cartridges 716 is loaded, the sliding front panel 714 can be released by pressing the spring loaded button 712 so as to disengage the button 712 from the hole 730, and then pushing the sliding front panel 714 back up into a closed position. The at least one finger pull 704 can then decompress the cartridge follower spring 710 and move the cartridge follower 706 up the finger-pull slot 708 so as to come in contact with the stack of cartridges 716 inside the ammunition magazine 700.

Figure 8A:
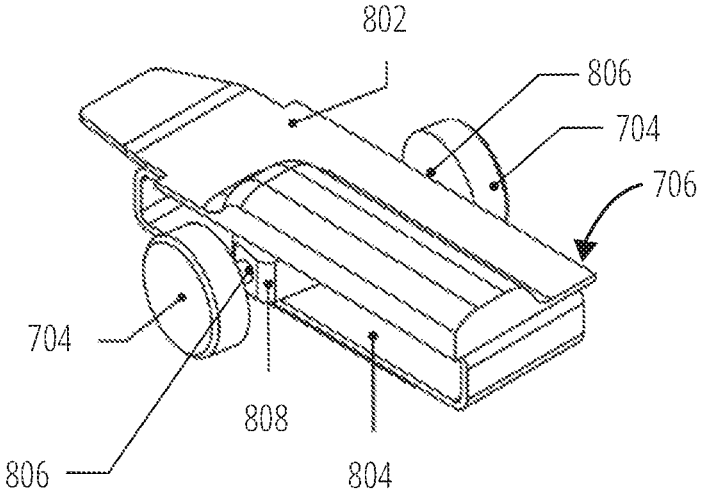
FIG. 8A is a perspective top view showing a cartridge follower having a U-shaped cartridge follower bottom plate, and two finger pulls for the embodiment featuring a sliding front panel.

With reference to FIG. 8A, a perspective top view is shown of a cartridge follower 706 with a U-shaped cartridge follower bottom plate 804 and two finger pulls 704. A cartridge follower top plate 802 is attached to the U-shaped cartridge follower bottom plate 804.

A rotatable shaft 806 is attached to a cartridge follower pivot block 808. The cartridge follower pivot block 808 extends through the cartridge follower 706 between the cartridge follower top plate 802 and the U-shaped cartridge follower bottom plate 804. On the other side of the cartridge follower 706, the cartridge follower pivot block 808 terminates at the rotatable shaft 806. Both finger pulls 704 are attached to the rotatable shaft 806.

Figure 8B:
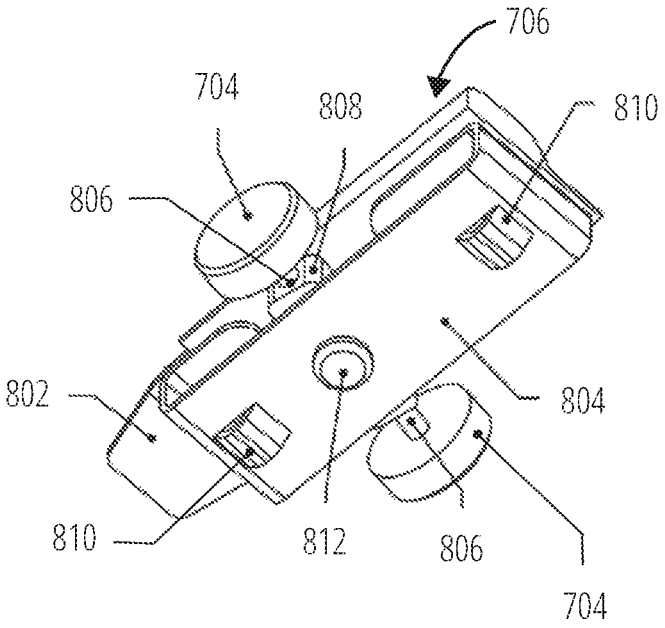
FIG. 8B is a perspective bottom view of the cartridge follower of FIG. 8A, having a U-shaped cartridge follower bottom plate and two finger pulls for the embodiment featuring a sliding front panel.

With reference to FIG. 8B, a perspective bottom view is shown of a cartridge follower 706 with a U-shaped cartridge follower bottom plate 804 and the two finger pulls 704.

A rotatable shaft 806 goes into a cartridge follower pivot block 808. A pivot 812 goes through the U-shaped cartridge follower bottom plate 804, through the cartridge follower pivot block 808 and attaches to a cartridge follower top plate 802. The pivot 812 is configured to allow the cartridge follower pivot block 808, the rotatable shaft 806, and the finger pulls 704 to rotate about the pivot 812. The cartridge follower spring 710 (shown in FIG. 7A) is attached to the cartridge follower 706 by an at least one spring attachment tab 810 attached to the bottom of the U-shaped cartridge follower bottom plate 804.

Installing the Fixed Magazine

To install the fixed magazine of the invention (e.g., any of the embodiments disclosed herein) on the firearm, the upper receiver is first separated from the lower receiver. Once the top of the lower receiver is exposed, the fixed magazine of the invention is inserted up into the magazine well.

In some embodiments of the invention, a blocking tab is then placed over the top of the fixed magazine such that the blocking tab overlaps a portion of the upper side of the lower receiver. The blocking tab is then attached to the fixed magazine using a screw which fixes the tab to both the lower receiver and the fixed magazine, so that the fixed magazine cannot be removed from the firearm without separating the upper receiver and the lower receiver.

Loading the Magazine

Because the magazine is fixed to the firearm while the upper receiver and the lower receiver of the firearm are engaged, the magazine cannot be loaded from the top of the fixed magazine. Instead, a side-loading method is used. A sliding panel located on one side of the magazine is opened to allow the magazine to be side-loaded with cartridges. In addition, when loading the magazine, one uses a finger-pull located in a slot on at least one side of the magazine to retract the spring-loaded cartridge follower.

During the loading process, at least one finger-pull is pulled down along at least one slot in the magazine. The finger-pull is locked in the down position by moving the finger-pull into a bottom hook, located at the bottom of the finger-pull slot. When the finger-pull is in the down and hooked position, the magazine spring is compressed, and the cartridge follower is locked in the down position.

The panel on the magazine is then opened by sliding the panel down, which reveals the magazine body, providing space for loading the stack of ammunition cartridges. Once this magazine body is opened, the user can easily load ammunition cartridges into the magazine body.

Once the stack of cartridges is loaded, the panel is closed by sliding it upwards, and at least one finger-pull is unhooked from the respective bottom hook. Once the finger-pull(s) is(are) released from the bottom hook(s), the cartridge follower pushes up against the stack of cartridges, allowing the magazine and the firearm to work normally.

Other modifications and implementations will occur to those skilled in the art without departing from the spirit and the scope of the invention as claimed. Accordingly, the above description is not intended to limit the invention, except as indicated in the following claims.

What is claimed is:

1. An affixable ammunition magazine configured for use with a firearm having an upper receiver and a lower receiver, the receivers configured to be disengaged and re-engaged, the lower receiver having a magazine well for receiving the ammunition magazine, the ammunition magazine comprising:

- a magazine body configured to contain a stack of cartridges, the magazine body having a feeding end configured to feed rounds of ammunition to the firearm, the magazine body including:
  - a sliding side panel configured to slide downward from a closed position to an open position so as to permit loading of the stack of cartridges into the magazine body, and
  - a rear side having a finger-pull slot terminating as a bottom hook;
- a cartridge follower assembly including:
  - a cartridge follower,
  - at least one finger pull attached to the cartridge follower, the at least one finger pull extending through the finger-pull slot of the rear side, the at least one finger pull being movable when released from the bottom hook, and a cartridge follower spring configured to be compressed by the cartridge follower when the at least one finger pull is engaged with the bottom hook, and configured to expand when the at least one finger pull is disengaged from the bottom hook, thereby allowing the cartridge follower to urge the stack of cartridges towards the feeding end of the magazine body; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

2. The affixable ammunition magazine of claim 1, wherein the cartridge follower includes a rotatable shaft configured to move along and within the finger-pull slot, the at least one finger pull being attached to the rotatable shaft.

3. The affixable ammunition magazine of claim 1, wherein the cartridge follower assembly further includes:

a cartridge follower top plate configured to push upward on the bottom of the stack of cartridges;

a cartridge follower bottom plate configured to facilitate attachment of the cartridge follower spring to the cartridge follower assembly;

a pivot extending from the bottom plate towards the top plate of the cartridge follower; and a pivot block mounted on the pivot so as to enable the pivot block, the rotatable shaft, and the at least one finger pull to pivot.

4. The affixable ammunition magazine of claim 3, wherein the cartridge follower bottom plate includes at least one spring attachment tab configured to attach the cartridge follower spring to the cartridge follower bottom plate.

5. The affixable ammunition magazine of claim 1, further comprising:

a spring loaded button located at a lower portion of the magazine body, the spring loaded button being cooperative with both a lower hole and an upper hole in the sliding side panel, so as to lock the sliding side panel in either the open position, or the closed position.

6. The affixable ammunition magazine of claim 1, wherein the magazine body, the sliding side panel, the cartridge follower, the cartridge follower spring, and the at least one finger pull are each made from at least one of: metal, nylon, plastic, carbon fiber.

7. An affixable ammunition magazine configured for use with a firearm having an upper receiver and a lower receiver, the receivers configured to be disengaged and re-engaged, the lower receiver having a magazine well for receiving the ammunition magazine, the ammunition magazine comprising:

a magazine body configured to contain a stack of cartridges, the magazine body having a feeding end configured to feed rounds of ammunition to the firearm, the magazine body including:

a sliding rear panel configured to slide downward from a closed position to an open position so as to permit loading of the stack of cartridges into the magazine body, and a right side and a left side each having a finger-pull slot terminating as a bottom hook;

a cartridge follower assembly including:

a cartridge follower, two finger pulls attached to the cartridge follower, the two finger pulls extending through the finger-pull slots of the right and left sides, the two finger pulls being movable when released from the respective bottom hooks, and a cartridge follower spring configured to be compressed by the cartridge follower when the at least one finger pull is engaged with the bottom hook, and configured to expand when the at least one finger pull is disengaged from the bottom hook, thereby allowing the cartridge follower to urge the stack of cartridges towards the feeding end of the magazine body; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

8. The affixable ammunition magazine for use of claim 7, wherein the two finger pulls are each attached to a respective rotatable shaft configured to ride within respective finger-pull slots.

9. The affixable ammunition magazine of claim 7, wherein the cartridge follower assembly further includes:

a cartridge follower top plate configured to push upward on the bottom of the stack of cartridges;

a cartridge follower bottom plate configured to facilitate attachment of the cartridge follower spring to the cartridge follower assembly;

a pivot extending from the bottom plate towards the top plate of the cartridge follower; and a pivot block mounted on the pivot so as to enable the pivot block, the rotatable shafts, and the two finger pulls to pivot.

10. The affixable ammunition magazine of claim 9, wherein the cartridge follower bottom plate includes at least one spring attachment tab configured to attach the cartridge follower spring to the cartridge follower bottom plate.

11. The affixable ammunition magazine of claim 7, further comprising:

a spring loaded button located at a lower portion of the magazine body, the spring loaded button being cooperative with both a lower hole and an upper hole in the sliding rear panel, so as to lock the sliding rear panel in either the open position, or the closed position.

12. The affixable ammunition magazine of claim 7, wherein the magazine body, the sliding rear panel, the cartridge follower, the cartridge follower spring, and the two finger pulls are each made from at least one of: metal, nylon, plastic, carbon fiber.

13. An affixable ammunition magazine configured for use with a firearm having an upper receiver and a lower receiver, the receivers configured to be disengaged and re-engaged, the lower receiver having a magazine well for receiving the ammunition magazine, the ammunition magazine comprising:

a magazine body configured to contain a stack of cartridges, the magazine body having a feeding end configured to feed rounds of ammunition to the firearm, the magazine body including:

a sliding front panel configured to slide downward from a closed position to an open position so as to permit loading of the stack of cartridges into the magazine body, and a right side and a left side each having a finger-pull slot terminating as a bottom hook;

a cartridge follower assembly including:

a cartridge follower, two finger pulls attached to the cartridge follower, the two finger pulls extending through the finger-pull slots of the right and left sides, the two finger pulls being movable when released from the respective bottom hooks, and a cartridge follower spring configured to be compressed by the cartridge follower when the at least one finger pull is engaged with the bottom hook, and configured to expand when the at least one finger pull is disengaged from the bottom hook, thereby allowing the cartridge follower to urge the stack of cartridges towards the feeding end of the magazine body; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

14. The affixable ammunition magazine for use of claim 13, wherein the two finger pulls are each attached to a respective rotatable shaft configured to ride within respective finger-pull slots.

15. The affixable ammunition magazine of claim 13, wherein the cartridge follower assembly further includes:

a cartridge follower top plate configured to push upward on the bottom of the stack of cartridges;

a cartridge follower bottom plate configured to facilitate attachment of the cartridge follower spring to the cartridge follower assembly;

a pivot extending from the bottom plate towards the top plate of the cartridge follower; and a pivot block mounted on the pivot so as to enable the pivot block, the rotatable shafts, and the two finger pulls to pivot.

16. The affixable ammunition magazine of claim 15, wherein the cartridge follower bottom plate includes at least one spring attachment tab configured to attach the cartridge follower spring to the cartridge follower bottom plate.

17. The affixable ammunition magazine of claim 13, further comprising:

a spring loaded button located at a lower portion of the magazine body, the spring loaded button being cooperative with both a lower hole and an upper hole in the sliding front panel, so as to lock the sliding front panel in either the open position, or the closed position.

18. The affixable ammunition magazine of claim 13, wherein the magazine body, the sliding front panel, the cartridge follower, the cartridge follower spring, and the two finger pulls are each made from at least one of: metal, nylon, carbon, fiber.

* * * * *